US007130439B2

(12) United States Patent
Chen

(10) Patent No.: US 7,130,439 B2
(45) Date of Patent: Oct. 31, 2006

(54) ROTARY CANISTER BASE

(75) Inventor: Guan-Nan Chen, Yilan Hsien (TW)

(73) Assignee: The 204th Arsenal, Materiel Production Center, Armament Bureau, M.N.D., Yilan Hsien (TW)

( * ) Notice: Subject to any disclaimer, the term of this patent is extended or adjusted under 35 U.S.C. 154(b) by 392 days.

(21) Appl. No.: 10/831,025

(22) Filed: Apr. 23, 2004

(65) Prior Publication Data

US 2005/0238193 A1 Oct. 27, 2005

(51) Int. Cl.
*H04R 25/00* (2006.01)

(52) U.S. Cl. ..... 381/376; 381/367; 381/375

(58) Field of Classification Search ..... 381/370, 381/375, 376, 344, 367, 384; 379/430, 175; 128/201.19, 204.22, 206.21, 206.15; 2/209, 2/422–424, 906; 455/575.2
See application file for complete search history.

(56) References Cited

U.S. PATENT DOCUMENTS 5,138,666 A * 8/1992 Bauer et al. ..... 381/367
6,382,206 B1 * 5/2002 Palazzotto et al. ..... 128/201.19
6,394,091 B1 * 5/2002 Giorgini ..... 128/206.21

* cited by examiner

*Primary Examiner*—Huyen Le
(74) *Attorney, Agent, or Firm*—Ladas and Parry LLP

(57) ABSTRACT

The invention relates to a rotary canister base comprising a loudspeaker, a drinking pipe and an air-intake pipe, wherein the loudspeaker serves as a communicating tool and the drinking pipe, which may be connected to a canteen, are all arranged within the confined space of the canister base. In addition, the drinking pipe, when unused, may be fixed onto the canister base. Most importantly, the air-intake pipe connected to the canister can be rotated and positioned at different angles so that the wearer may adjust the direction of the canister to avoid interference with the ambient space when fleeing for life.

11 Claims, 5 Drawing Sheets

ROTARY CANISTER BASE

BACKGROUND OF THE INVENTION

1. Field of Invention

The invention relates to a canister base of a mask, which is mounted on the oral and nasal part of the mask with an air-intake pipe connected to the canister. The air-intake pipe may be rotated and thereby the direction of canister is adjusted to adapt to the ambient space.

2. Description of the Related Art

A mask generally includes three primary components: a mask body, a canister, and a canister base connected to the mask body and the canister. The canister base may further comprise a loudspeaker, a drinking pipe, and an air-intake pipe.

The loudspeaker serves as a communication tool for the wearer. Since the air in the mask is blocked therein by the mask, the wearer's voice is mostly isolated from propagation. Thus, a loudspeaker is needed to amplify the sound to make it audible.

The drinking pipe is provided to serve the needs of the wearer of the mask when the wearer has to wear the mask for a long period of time. The drinking pipe extends out from inside of the canister base. When in use, one end of said drinking pipe is put into the wearer's mouth while the other end is connected to a canteen. When unused, the drinking pipe may be fixed onto the canister base.

The air-intake pipe is used in combination with the canister. Contaminated or toxic air becomes clean and non-toxic after filtered by the filter contained in the canister and then flows into the canister base through the air-intake pipe.

The canister usually protrudes substantially from the mask and takes up substantial space. In a confined space, a protruding canister often causes interference and hinders the wearer's action of fleeing or lifesaving.

There are about two viable ways to avoid interference on the canister. One is to manufacture a smaller canister without reducing its filtering efficiency. The possibility to reduce the size of a canister can be expected if more efficient filtering material is developed and larger filtering area can be packed into the limited space in a filter. Another feasible way is make the canister adjustable in orientation to adapt to the confined space where the wearer is in. And thus, the canister may still be adapted to the space without changing its volume.

SUMMARY OF INVENTION

The invention relates to a canister base of a mask, a component connected between a mask body and a canister. In addition to the arrangement of the channels for inhaling and exhaling air, the canister base further comprises a loudspeaker and a drinking system so that the wearer may still communicate with outside and drink water. In the canister base of the present invention, the inhaling channel, exhaling channel, loudspeaker, and drinking system are all integrated into the canister base so that the mask would not interfere with the wearer's environment. The canister base may also comprise a microphone to amplify the volume of the voice to prevent the wearer from being overwhelmed by environmental noises.

In addition to the above improvement in space-saving, the present invention is specifically characterized in that the intake pipe may rotate so that the canister can be oriented to prevent interference with environment. Generally, a mask is used under dangerous situation and in a confined space. With the canister protruding substantially from the wearer's mask, the wearer can be impeded by the mask when he tries to flee for life. Under this situation, the rotating feature of the intake pipe appears to be particularly important.

DETAILED DESCRIPTION OF THE INVENTION

The internal configuration of the canister base of the invention and the design of the rotary air-intake pipe are illustrated in the preferred embodiments shown in above drawings.

Figure 1:
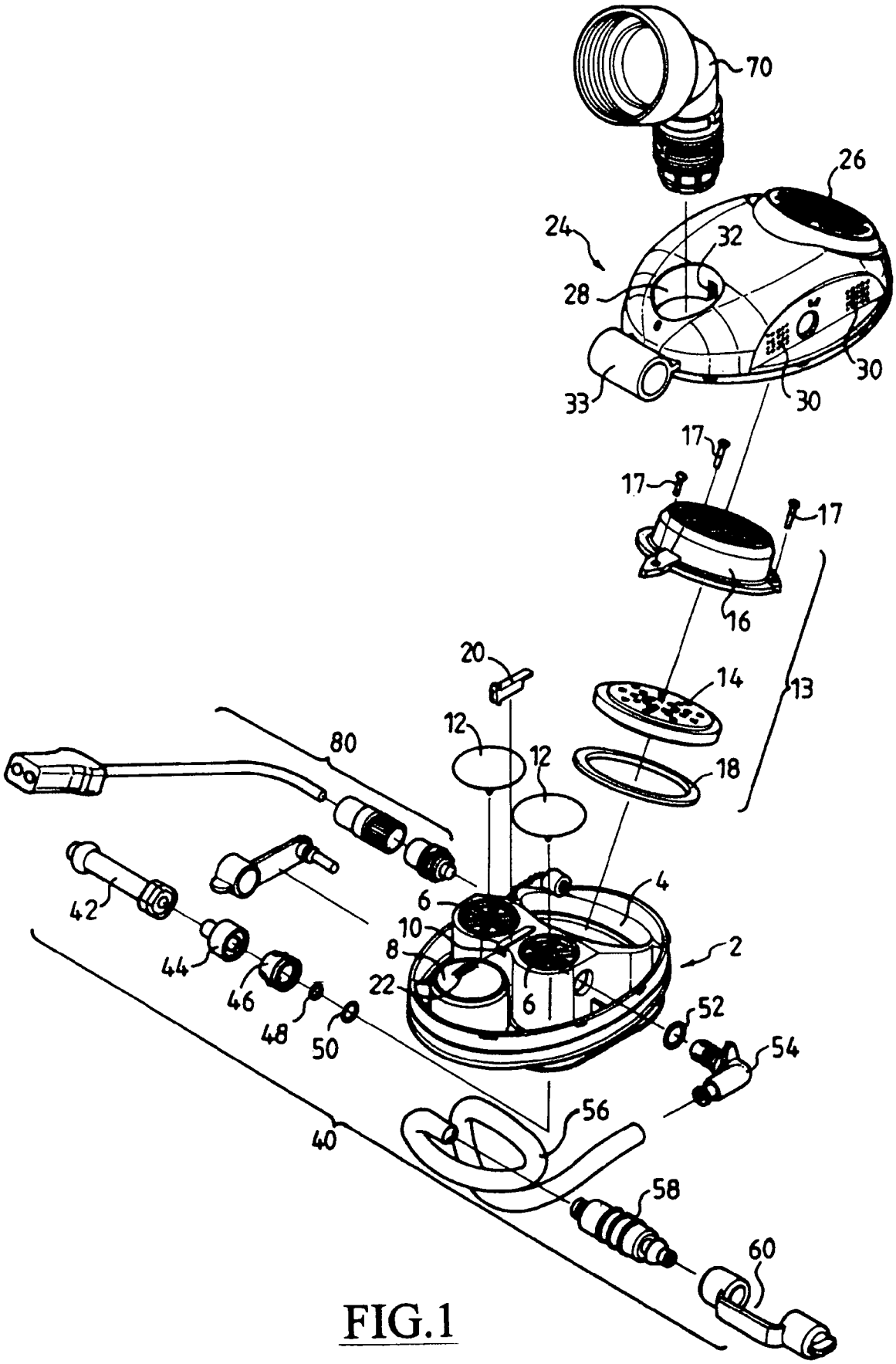
FIG. 1 is an exploded view of the canister base of the present invention.

FIG. 1 shows an exploded view of the canister base of the invention, which mainly comprises a body 2, an outer cover 24, an air-intake pipe 70, a loudspeaker system 13, a drinking system 40, and a microphone system 80.

The body 2 generally has an elliptical profile with a space 4 in the upper part for receiving a loudspeaker system 13. The loudspeaker system 13 comprises a washer 18, a loudspeaker 14, and a loudspeaker cover 16, which are mounted in sequence within the space 4, and then are fastened onto the body 2 with bolts 17.

The lower part of the body 2 is provided with exhaling channels 6 and an inhaling channel 8, wherein the exhaling channels 6 have spoke-shaped openings covered by valve pieces 12. The inhaling channel 8 has a round-pipe shape and is located below the exhaling channels 6. A slot 10 having a closed end and an open end facing the inhaling channel 8.

A stopper 20 is mounted in the slot 10 and is allowed to slide along the slot 10. A spring 22 is inserted between the closed end of the slot 10 and the stopper 20.

The profile of the outer cover 24 corresponds to that of the body 2 and is mounted on it. The outer cover 24 mainly comprises a plurality of holes 26, a round channel 28, a plurality of apertures 30, a slot 32, and a sleeve 33. The plurality of holes 26 are provided in correspondence with the space 4 of the body 2. The round channel 28 is located in correspondence with the intake pipe 8 of the body 2. A slot 32 is provided on the wall of the round channel 28 with its longitudinal direction aligned with the axial direction of the inhaling channel. A plurality of apertures 30 are provided on the outer cover 24, but apart from the locations of the holes 26 and the round channel 28.

The drinking system 40 mainly comprises a mouthpiece 42, a pipe sleeve 44, an orienting sleeve 46, a washer 48, a washer 50, a washer 52, an elbow 54, a drinking pipe 56, a connecting pipe 58, and a pipe lid 60, as shown in FIG. 1, and are assembled sequentially from inside the body 2, through the shell of the body 2, to the outer cover 24. After the assembling is completed, the mouthpiece 42, the pipe sleeve 44, the orienting sleeve 46, the washer 48, and the washer 50 are located inside the body 2, whereas the washer 52, the elbow 54, the drinking pipe 56, the connecting pipe 58, and the pipe lid 60 are located outside of the body 2. The drinking system 40, after assembling, will have a drinking pipe with one end connected to a canteen (not shown) and the other end being held in the wearer's mouth. The connecting pipe 58 may be fixed onto the sleeve 33 of the outer cover 24 when the drinking system is not connected to the canteen.

Figure 2A:
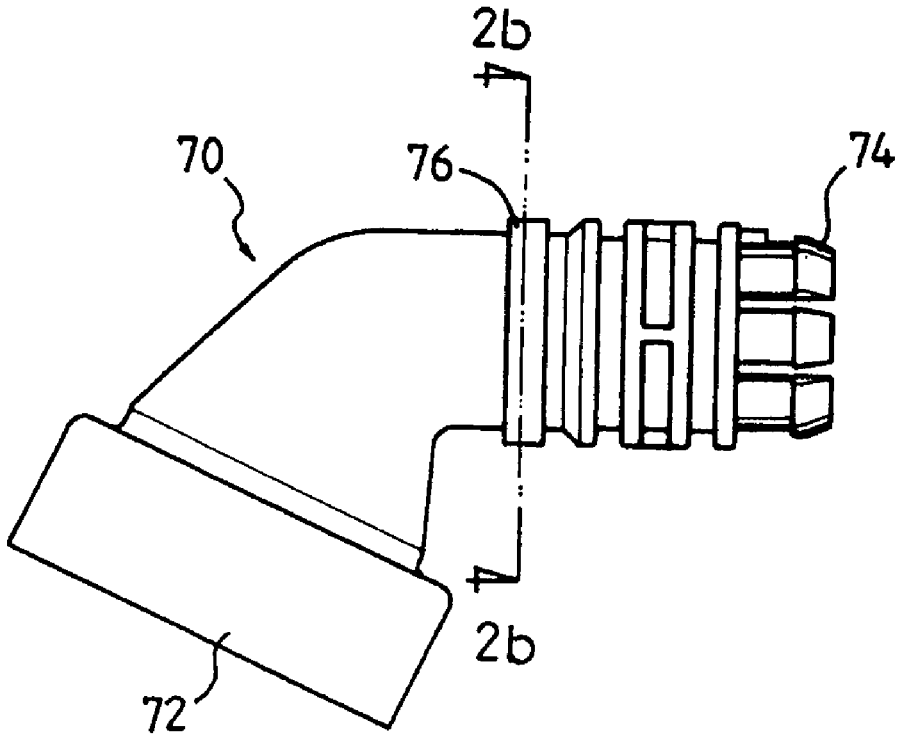
FIG. 2*a* and FIG. 2*b* are detailed drawings of the air-intake pipe of the canister base of the present invention.
Figure 2B:
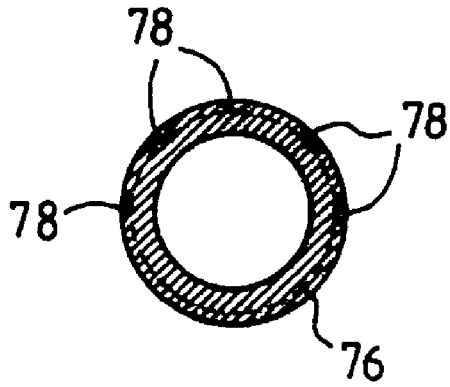
Figure 4A:
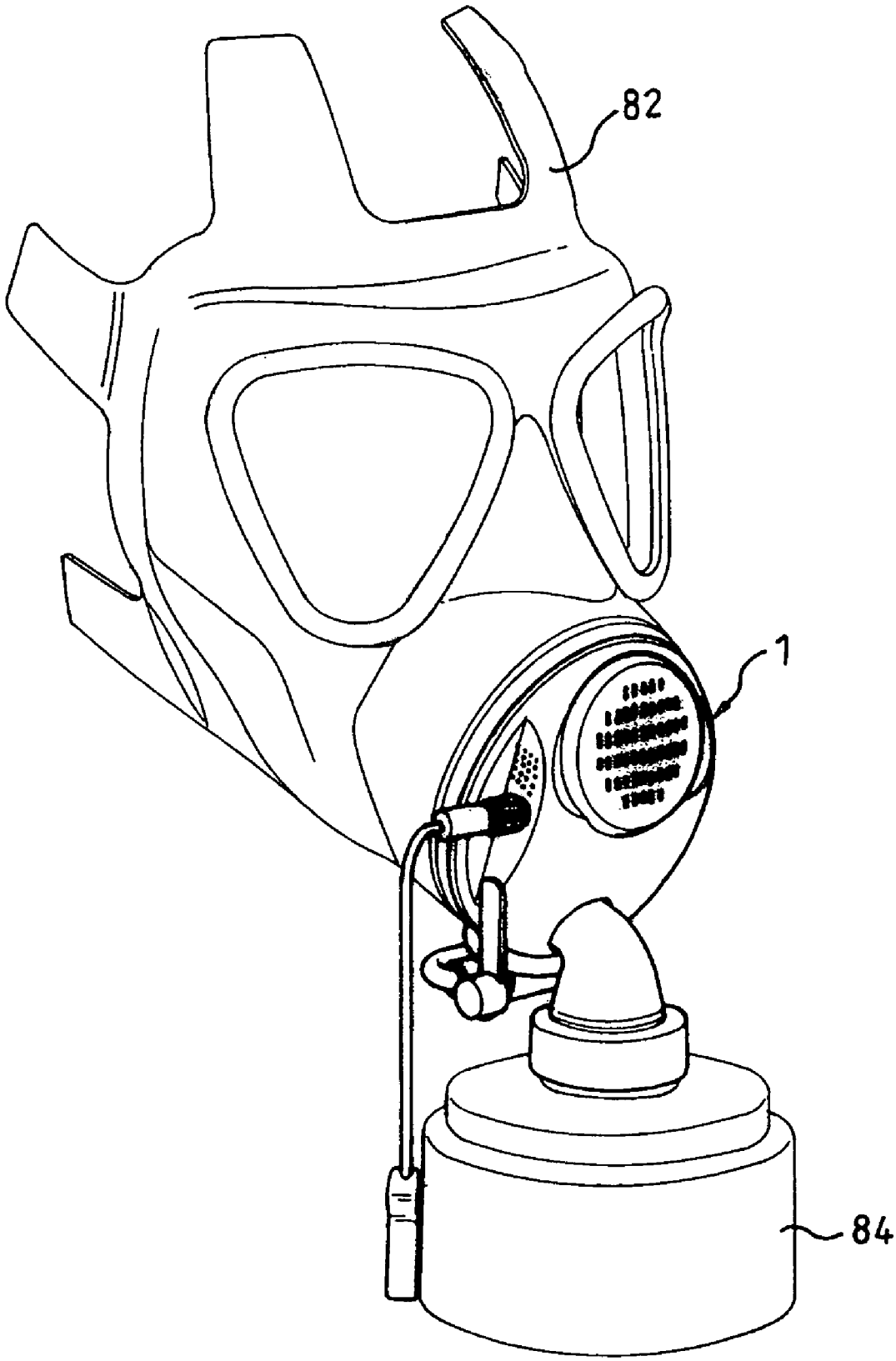
FIG. 4*a* and FIG. 4*b* show the canister at two different positions.

As shown in FIG. 1 and FIG. 2*a*, one end 72 of the air-intake pipe 70 is connected to a canister 84 (as shown in FIG. 4*a*), and the other end 74 is plugged into the round channel 28 of the outer cover 24. A plurality of slits may be provided around the end 74 to facilitate the pipe 70 plugged into the round channel 28. The outside wall of the air-intake pipe 70 has a flange 76, and several notches 78 (as shown in FIG. 2*b*) are provided around the flange 76. As shown in FIG. 2*b*, there are five notches 78 on the flange 76, and one of the notches (the first notch) is located at an angular position of 12 o'clock, and the other four are located relative to the first notch at positive and negative 45 degrees, positive and negative 90 degrees, respectively on the said flange. An angle ranging between 90~180 degrees, and preferably 115 degrees, is included between the two axial directions of both ends 72, 74 of the air-intake pipe 70 in view of space-saving and meeting requirement of ergonomics.

When the outer cover 24 is connected to the body 2, the stopper 20 passes through the slot 32 of the outer cover 24, and under the force of a spring 22, the stopper 20 locks into one of the notches 78. Thus, when the air-intake pipe 70 is rotated, it is locked at the angular positions where the notches 78 are located.

In addition, the canister base 1 of this invention may be connected with a microphone system 80 in order to raise the volume of the voice. As shown in FIG. 1, a microphone system 80 is preferably connected to the canister base 1 at the side thereof.

Figure 3:
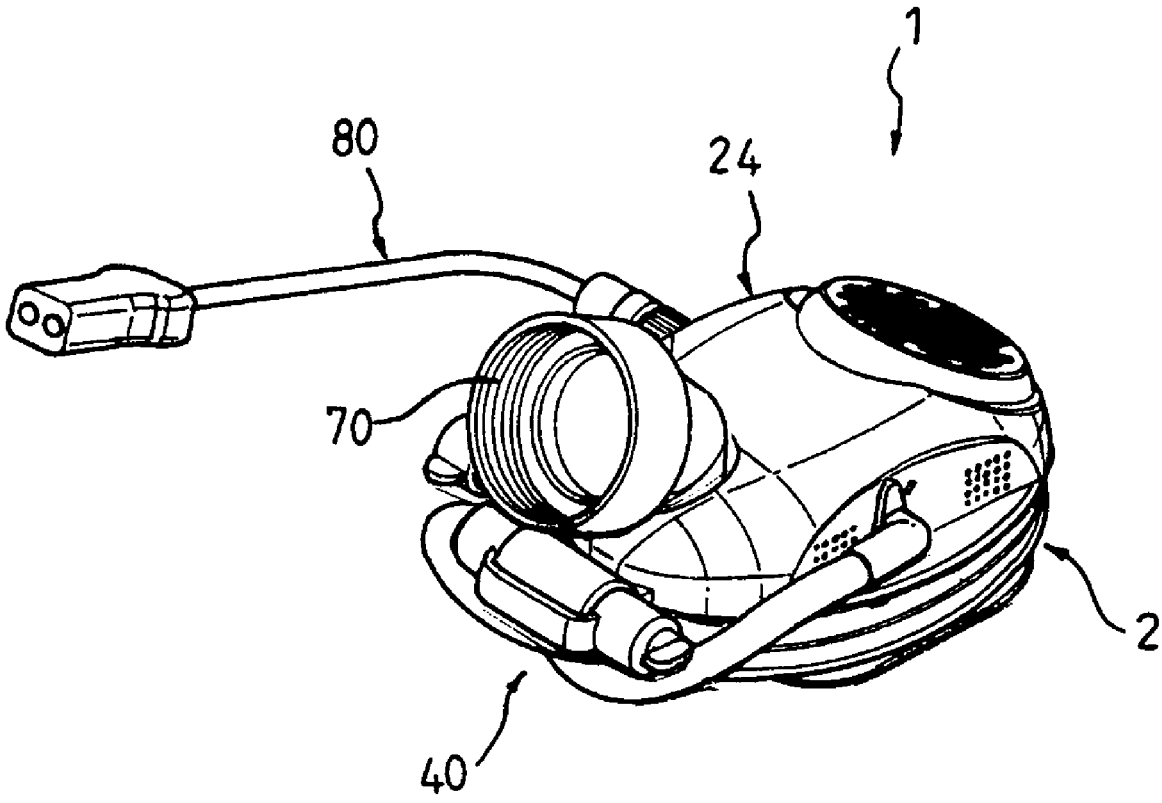
FIG. 3 is a perspective view showing the assembled canister base of the present invention.
Figure 4B:
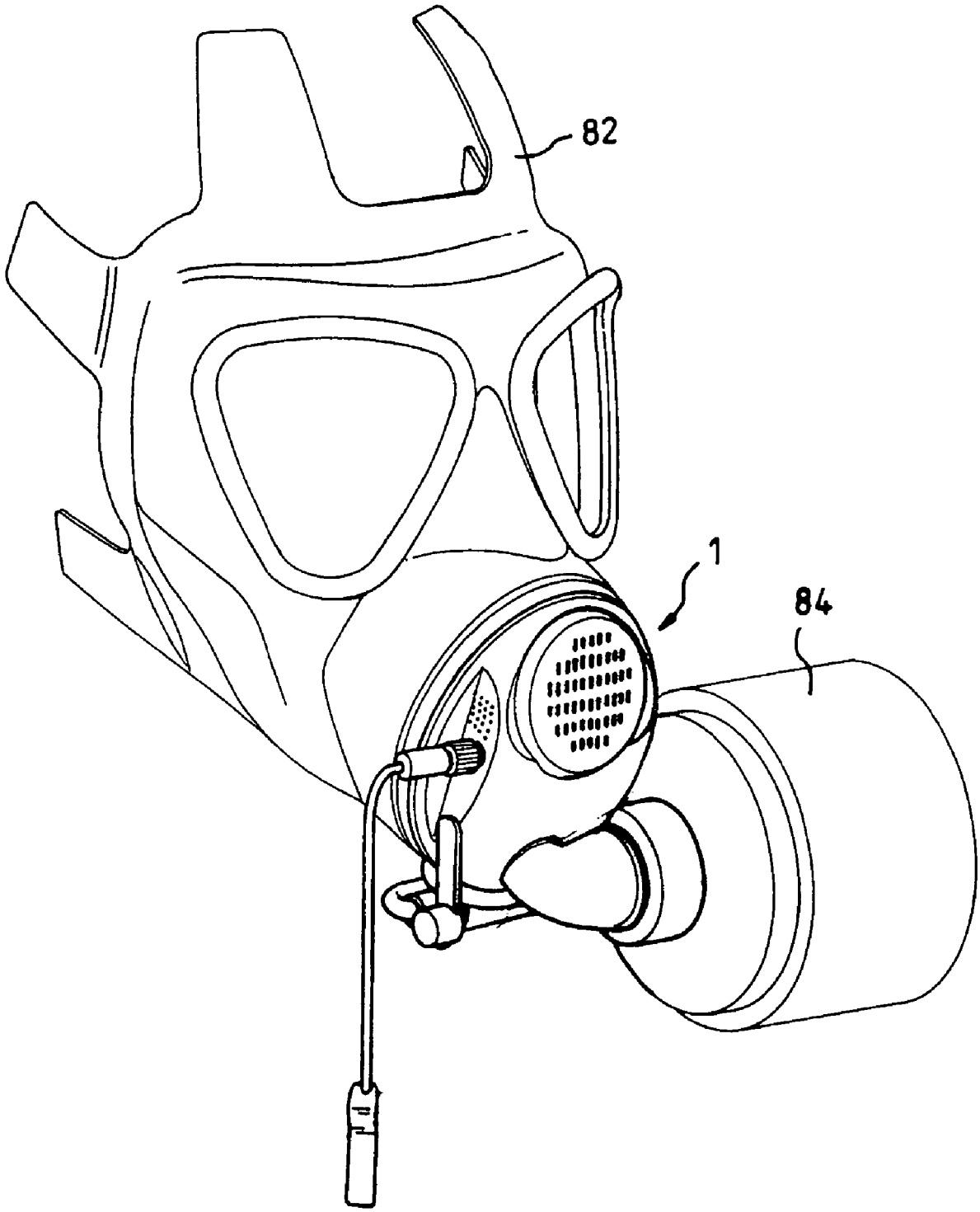

FIG. 3 shows the appearance of the assembled canister base 1 of the invention. FIG. 4*a* and FIG. 4*b* show the state of the canister base 1 connected with a mask body 82 and a canister 84, wherein the air-intake 70 is rotated to 0 and 90 degrees, respectively.

The structure and characteristics of the invention will be more concrete through above detailed description and illustration. It should be emphasized that the embodiment is only used as an example to describe the preferred operation of the invention, not for limiting the scope of the invention. Any improvements or changes without departing from the spirit of the invention shall be protected by the present invention.

What is claimed is:

1. A rotary canister base, comprising:

a body having a space for receiving a loudspeaker, two exhaling channels, an air inhaling channel, and a slot, wherein the slot has a closed end and an open end facing the inhaling channel;

two valve pieces arranged at the opening of exhaling channels of the body;

a loudspeaker system arranged in the space for receiving the loudspeaker, comprising a washer, the loudspeaker, and a loudspeaker cover;

a stopper arranged at the slot of the body;

an outer cover having a shape corresponding to that of the body and being connected to the body, and being provided with a plurality of holes at the position corresponding to the space of the body for receiving the loudspeaker, and being provided with a round channel at the position corresponding to the inhaling channel of the body, the outer cover being further provided with several apertures to be in communication with the exhaling channels on the body, and a slot being provided on the round channel wall;

a drinking system for use as a drinking pipe protruding out from inside of the body, passing through the body and the outer cover, and when in use, one end of the drinking pipe being kept in the wearer's mouth and the other end connected to a canteen; and an air-intake pipe having one end connected to a canister and the other end plugged into the round channel of the outer cover, and being provided with several notches on a flange of the outside wall thereof, and allowing the stopper to pass through the slot on the round channel of the outer cover and to lock into the notches under the force of a spring.

2. The rotary canister base of claim 1, wherein an angle is formed between the two axes of both ends of the air-intake pipe.

3. The rotary canister base of claim 2, wherein the air-intake pipe has five notches.

4. The rotary canister base of claim 3, wherein one of the five notches is provided at the position of 12 o'clock of the flange, the other four notches are provided at positive and negative 45 degrees, positive and negative 90 degrees relative to the 12 o'clock position on said flange, respectively.

5. The rotary canister base of claim 4, wherein the end of the air-intake pipe to be plugged into the outer cover is configured to have a plurality of slits.

6. The rotary canister base of claim 5, wherein the angle included between the two axes of both ends of the air-intake pipe is between 90~180 degrees.

7. The rotary canister base of claim 5 wherein the angle included between the two axes of both ends of the air-intake pipe is 150 degrees.

8. The rotary canister base of claim 1, further comprises a microphone system.

9. The rotary canister base of claim 1, wherein the outer cover comprises a sleeve.

10. The rotary canister base of claim 9, wherein the sleeve is provided at the bottom of the outer cover.

11. The rotary canister base of claim 10, wherein said drinking system comprises a mouthpiece, a pipe sleeve, an orienting sleeve, an elbow, a drinking pipe, a connecting pipe, and a pipe lid, which are assembled sequentially with the drinking pipe passing through the sleeve.

* * * * *